US007624543B2

(12) United States Patent
Sample et al.

(10) Patent No.: US 7,624,543 B2
(45) **Date of Patent: *Dec. 1, 2009**

(54) PORTABLE DECONTAMINATION SYSTEM

(75) Inventors: Chad Sample, Glenn Dale, MD (US); Richard A. Esser, Glenn Dale, MD (US)

(73) Assignee: Branch Banking and Trust Company, McLean, VA (US)

( * ) Notice: Subject to any disclaimer, the term of this patent is extended or adjusted under 35 U.S.C. 154(b) by 127 days.

This patent is subject to a terminal disclaimer.

(21) Appl. No.: 11/529,642

(22) Filed: Sep. 29, 2006

(65) Prior Publication Data

US 2007/0095375 A1 May 3, 2007

Related U.S. Application Data

(63) Continuation of application No. 10/256,239, filed on Sep. 27, 2002, now Pat. No. 7,131,236.

(60) Provisional application No. 60/324,908, filed on Sep. 27, 2001.

(51) Int. Cl.
*E04H 14/00* (2006.01)

(52) U.S. Cl. ..... 52/79.5; 52/646; 52/8; 135/131; 135/97; 135/144; 4/597; 4/599; 4/602

(58) Field of Classification Search ..... 52/63, 52/646, 33, 79.5, 83; 135/96, 97, 128, 131, 135/93, 94, 143, 144, 130, 145, 147; 4/600, 4/597, 599, 602

See application file for complete search history.

(56) References Cited

U.S. PATENT DOCUMENTS 2,665,171 A 1/1954 Stievater
2,812,769 A 11/1957 Schaefer et al.
3,208,083 A 9/1965 Witczak
3,391,409 A 7/1968 Gatley
4,473,986 A 10/1984 Ziegler
4,512,097 A 4/1985 Ziegler
4,522,008 A 6/1985 Ziegler (Continued)

FOREIGN PATENT DOCUMENTS

EP 0 353 999 A2 2/1990

(Continued)

OTHER PUBLICATIONS

North American Rescue Products, Inc. Product Catalog, 2001.

(Continued)

*Primary Examiner*—Richard E Chilcot, Jr.
*Assistant Examiner*—Chi Q Nguyen
(74) *Attorney, Agent, or Firm*—Duane Morris LLP

(57) ABSTRACT

A portable decontamination system includes a preassembled shelter, convertible between a stowed configuration and a deployed configuration, and a fluid delivery system integral with the shelter. In the stowed configuration the shelter encloses a negligible volume. In the deployed configuration the shelter comprises a plurality of side walls, a plurality of end walls, and a roof. The walls and the roof define a central space. The fluid delivery system is configured to convey decontamination fluid into the shelter and to distribute decontamination fluid throughout at least a portion of the central space.

29 Claims, 10 Drawing Sheets

U.S. PATENT DOCUMENTS

| | | | |
|---|---|---|---|
| 4,561,618 | A | 12/1985 | Ziegler |
| 4,579,066 | A | 4/1986 | Ziegler |
| 4,637,180 | A | 1/1987 | Ziegler |
| 4,675,923 | A | 6/1987 | Ashley |
| 4,689,932 | A | 9/1987 | Ziegler |
| 4,707,953 | A | 11/1987 | Anderson et al. |
| 4,747,239 | A | 5/1988 | Ziegler |
| 4,761,929 | A | 8/1988 | Ziegler |
| 4,800,597 | A | 1/1989 | Healey |
| 4,800,663 | A | 1/1989 | Ziegler |
| 4,838,003 | A | 6/1989 | Ziegler |
| 4,934,396 | A | 6/1990 | Vitta |
| 4,970,841 | A | 11/1990 | Ziegler |
| RE33,710 | E | 10/1991 | Ziegler |
| 5,216,763 | A | 6/1993 | Grenier |
| 5,230,196 | A | 7/1993 | Ziegler |
| 5,274,980 | A | 1/1994 | Ziegler |
| 5,375,275 | A | 12/1994 | Sanders |
| 5,444,946 | A | 8/1995 | Ziegler |
| 5,446,930 | A | 9/1995 | Clark |
| 5,469,587 | A | 11/1995 | Demeny |
| 5,542,730 | A | 8/1996 | Riesselmann |
| 5,651,228 | A | 7/1997 | Ziegler |
| 5,794,640 | A | 8/1998 | Jang |
| 5,934,301 | A | 8/1999 | Carter |
| 5,943,837 | A | 8/1999 | Esser et al. |
| 6,035,877 | A | 3/2000 | Losi et al. |
| 6,141,934 | A | 11/2000 | Ziegler |
| 6,192,633 | B1 | 2/2001 | Hilbert |
| 6,237,860 | B1 | 5/2001 | Ducey |
| 6,244,011 | B1 | 6/2001 | Esser |
| 6,725,873 | B2 | 4/2004 | Liu |
| 6,779,538 | B2 | 8/2004 | Morgante et al. |
| 7,131,236 | B2 * | 11/2006 | Sample et al. ..... 52/79.5 |
| 2003/0037812 | A1 | 2/2003 | Stewart et al. |

FOREIGN PATENT DOCUMENTS

| | | |
|---|---|---|
| FR | 1 105 645 | 12/1955 |
| WO | WO 92/04510 | 3/1992 |

OTHER PUBLICATIONS

Reeves Manufacturing Inc. Product Catalog.
Fernomir Major Incident Response. Product Catalog.
Plysu Protection Systems. Product Catalog.
Reeves Manufacturing Inc., Aireshelta Inflatable Buildings Product Catalog.

* cited by examiner

PORTABLE DECONTAMINATION SYSTEM

PRIORITY DATA

This application is a continuation of U.S. application Ser. No. 10/256,239, filed Sep. 27, 2002, now U.S. Pat. No. 7,131,236, which claims priority under 35 U.S.C. § 119 of U.S. Provisional Patent Application No. 60/324,908, filed Sep. 27, 2001.

BACKGROUND OF THE INVENTION

1. Field of the Invention

The present invention relates to a decontamination system and, more particularly, to a portable decontamination system that is lightweight and rapidly deployable.

2. Description of the Related Art

Portable structures, including those having shower hardware, are known in the art. These conventional devices, however, have logistical and structural limitations that make them unsuitable for a range of applications.

Many conventional devices have complex structural supports that must be disassembled when the device is stored and transported. The supports must then be reassembled at the time and place where the device is to be used, such as a staging area or accident scene. Assembly of structural supports may be difficult in dark or otherwise inhospitable locations. Further, the continual assembly and disassembly of the structure requires tools, often specialized tools, and inevitably results in lost and broken parts.

Many conventional devices require a significant amount of time for assembly. Moreover, in some cases, considerable training is required to enable one or more workers to carry out the assembly. This may be particularly troublesome in situations where time is of the essence, such as responding to emergency situations.

In addition to these logistical drawbacks, conventional portable structures have significant functional limitations. Most of these devices are relatively small, accommodating at most only a few people at a time. Further, conventional devices make no provision for accommodating the wounded, such as those on stretchers, for example.

Still further, most conventional portable shower structures are not fully enclosed. In many devices the top is open to allow for the entry of water from the shower hardware. These open structures are totally unsuitable for containing any sort of harmful or hazardous substance.

SUMMARY OF THE INVENTION

To overcome the drawbacks of the prior art and in accordance with the purpose of the invention, as embodied and broadly described herein, one aspect of the invention relates to a portable decontamination system comprising a preassembled shelter. The preassembled shelter is convertible between a stowed configuration, in which the shelter encloses a negligible volume, and a deployed configuration, in which the shelter comprises a plurality of side walls, a plurality of end walls, and a roof. The walls and the roof define a central space. A fluid delivery system is integral with the shelter. The fluid delivery system is configured to convey decontamination fluid into the shelter and to distribute decontamination fluid throughout at least a portion of the central space.

In another aspect, the invention relates to a portable decontamination system comprising a preassembled shelter. The preassembled shelter comprises a frame movable between a stowed configuration and a deployed configuration and a canopy associated with the frame. The frame comprises a plurality of struts. Each strut comprises a first end, a second end, and an intermediate portion, wherein the intermediate portion of each strut is pivotally connected to the intermediate portion of another strut. The frame further comprises a plurality of first hubs defining a first frame surface. Each first hub receives first ends of at least two respective struts and each respective strut is pivotable with respect to the first hub about a distinct axis. The frame further comprises a plurality of second hubs defining a second frame surface. Each second hub receiving second ends of at least two respective struts and each respective strut is pivotable with respect to the second hub about a distinct axis. The frame in the deployed configuration and the canopy enclose a central space.

Other aspects will be apparent from the following description. It should be understood that the invention, in its broadest sense, may be practiced without having one or more of the aspects described herein.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several exemplary embodiments of the invention and together with the description, serve to explain the principles of the invention. In the drawings.

DETAILED DESCRIPTION OF EXEMPLARY EMBODIMENTS

Reference will now be made in detail to the exemplary embodiments of the invention, examples of which are illustrated in the accompanying drawings. It should be understood that all embodiments discussed herein are exemplary regardless of whether they are referred to as "exemplary" embodiments. Wherever possible, the same reference numbers will be used throughout the drawings to refer to the same or like parts.

The present invention provides a portable decontamination system that is rugged, yet lightweight, easily stored and transported, and easily deployed. Further, the system of the present invention may be deployed manually and without tools in a variety of inhospitable environments. The system provides a means for decontaminating a range of items, including, for example, personnel and equipment, after exposure to contaminants and/or hazardous substances.

The portable decontamination system may be used in a range of applications, including, for example, military, commercial, government, and/or consumer applications. Examples of applications include decontamination associated with emergencies and/or accidents, such as, for example, chemical spills and radiation leaks. Further examples include decontamination in response to military or terrorist attacks involving chemical, radioactive, and/or biological agents. Non-emergency applications include those associated with commercial activity, including, for example, periodic decontamination of workers and/or equipment. Many other applications for the system of the present invention are also envisioned.

Figure 1:
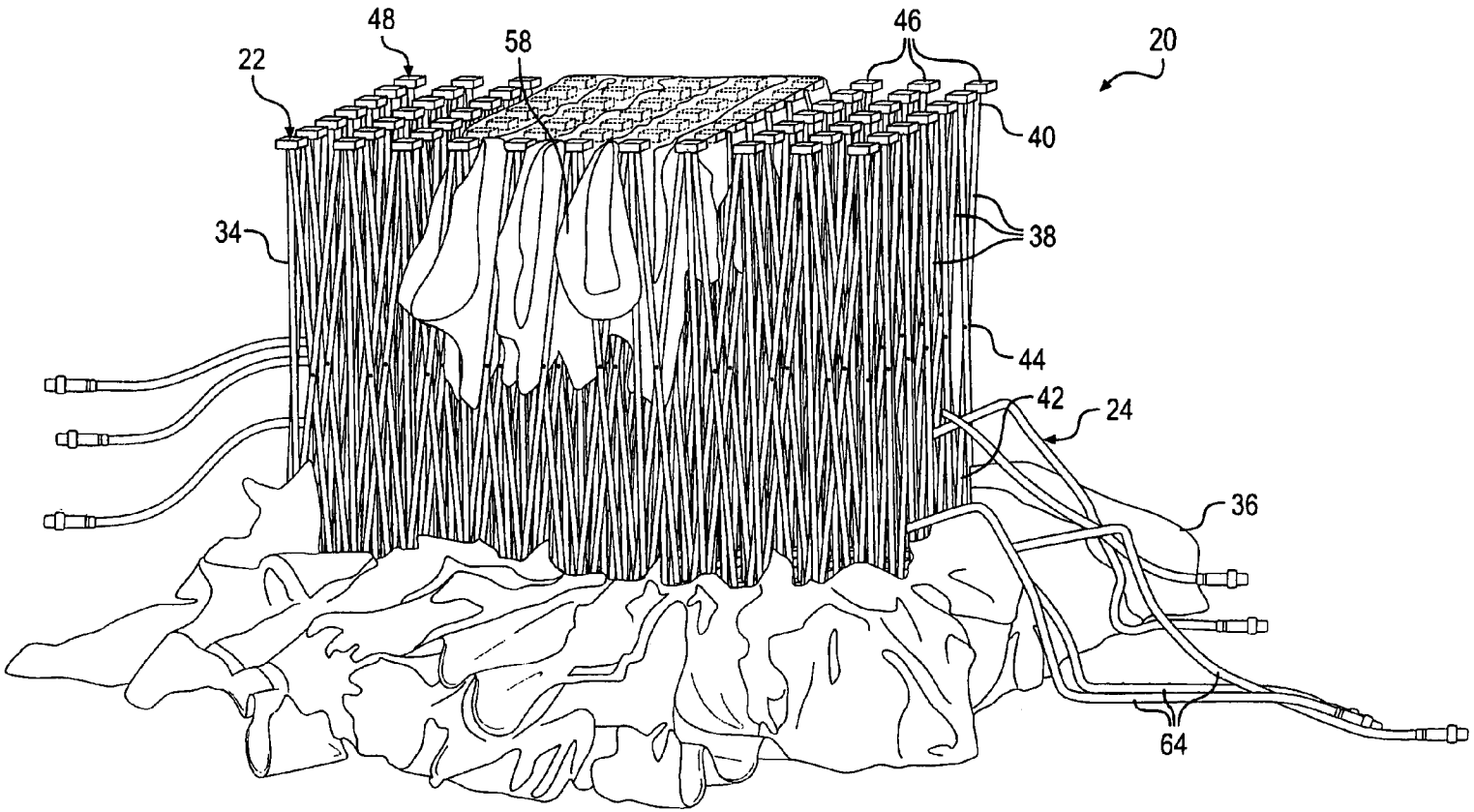
FIG. 1 is a perspective view of an embodiment of the decontamination system of the present invention with the shelter in the stowed configuration.
Figure 2:
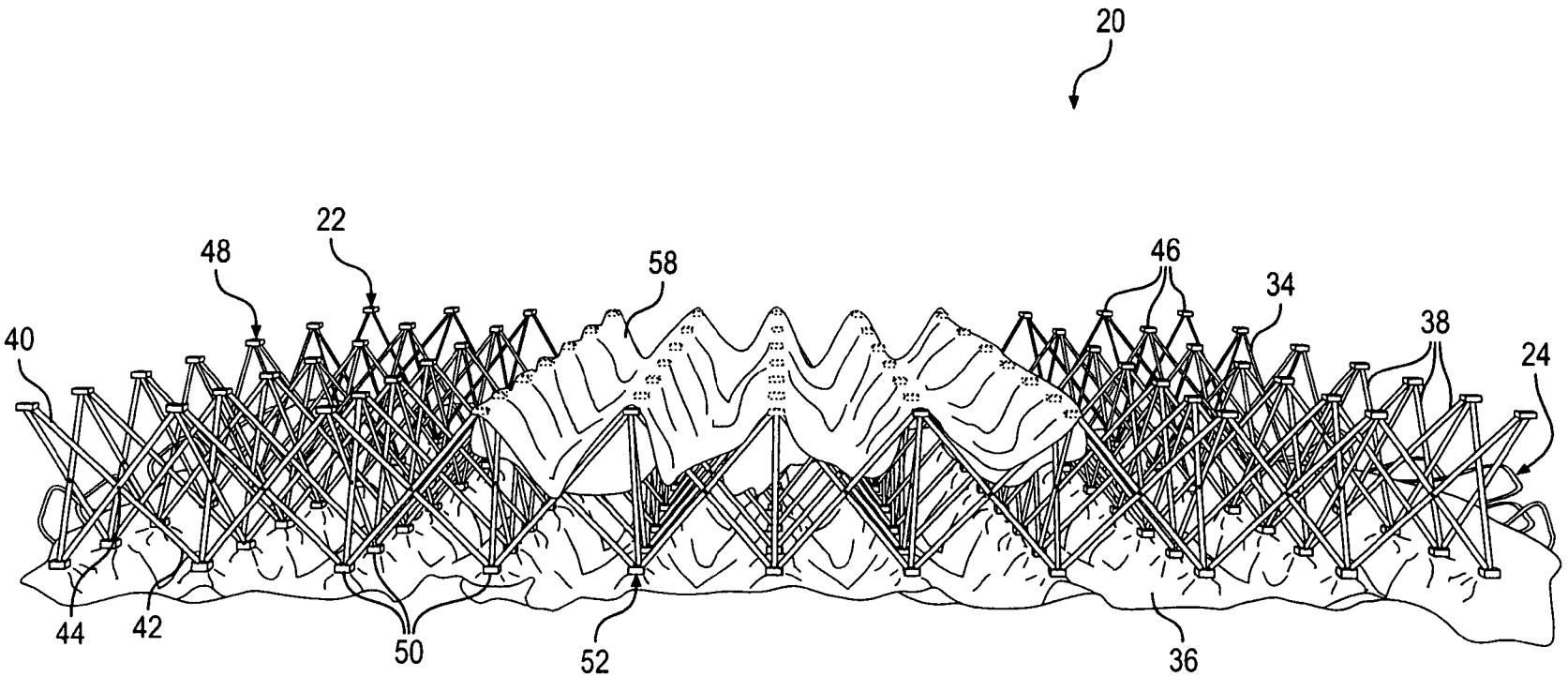
FIG. 2 is a perspective view of the decontamination system of FIG. 1 with the shelter between the stowed configuration and the deployed configuration.
Figure 3:
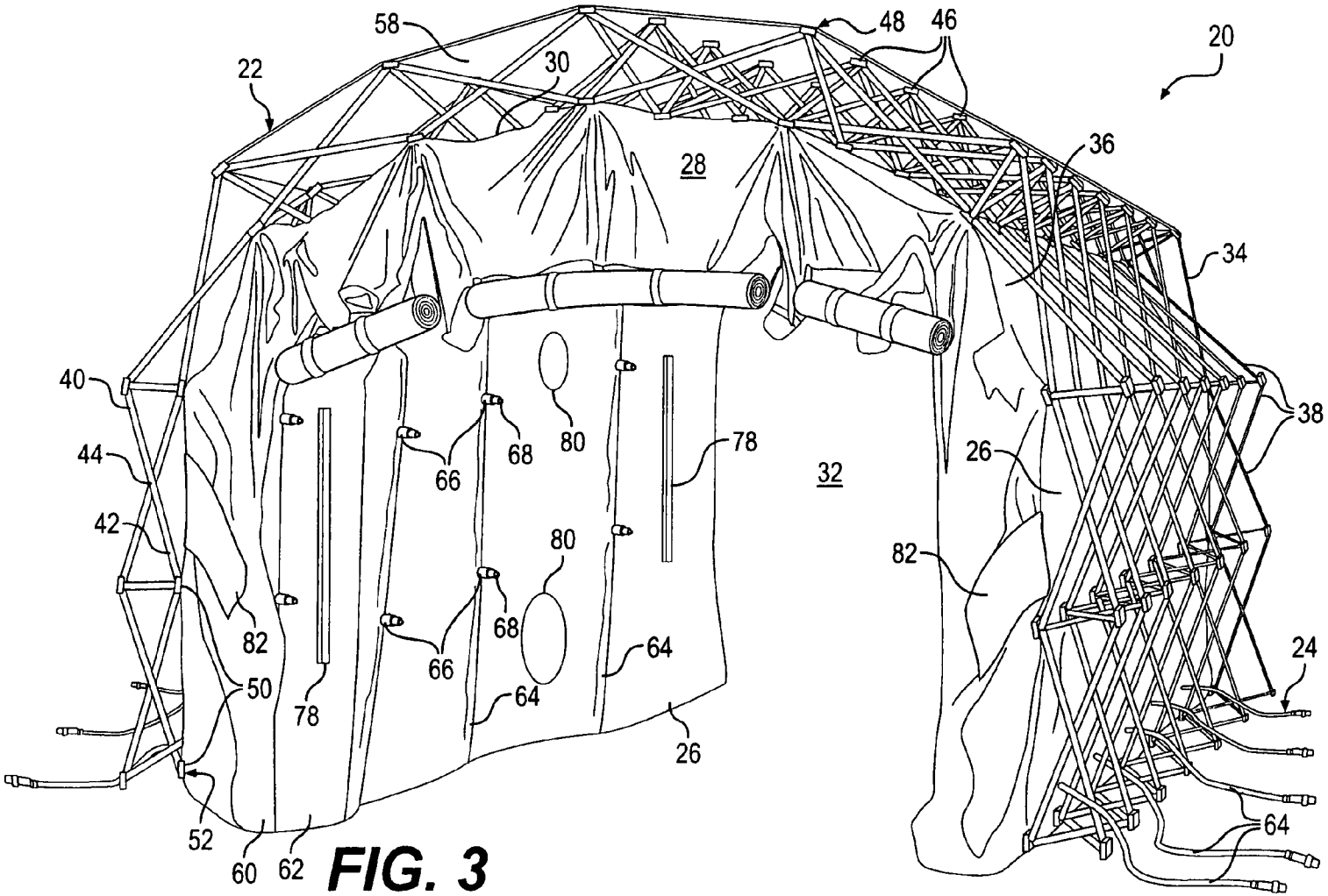
FIG. 3 is a perspective view of the decontamination system of FIG. 1 with the shelter in the deployed configuration.

An embodiment of the portable decontamination system 20 of the present invention is shown in FIGS. 1-3. The portable decontamination system 20 comprises a preassembled shelter 22, convertible between a stowed configuration (FIG. 1) and a deployed configuration (FIG. 3), and a fluid delivery system 24 integral with the shelter. As used herein, "preassembled" means substantially no assembly or disassembly of the components of the shelter 22 is required to convert the shelter from the stowed configuration to the deployed configuration and vice versa.

In the stowed configuration, shown in FIG. 1, the shelter 22 encloses a negligible volume. FIG. 2 shows the shelter 22 in a partially deployed state between the stowed configuration and the deployed configuration. In the deployed configuration, shown in FIG. 3, the shelter 22 comprises a plurality of side walls 26, a plurality of end walls 28, and a roof 30. The walls 26, 28 and the roof 30 of the shelter 22 define a central space 32.

The end walls 28 may be selectively sealed using zippers and/or hook and loop fasteners to enclose the central space 32. Other fasteners may also be used. Accordingly, the portable decontamination system 20 provides a means for containing airborne contaminants. The system may also be used with a variety of containment basins, either internal or external to the shelter, to fully contain the contaminants removed by the decontamination fluid. Where the application permits, the end walls 28 of the shelter are retractable and releasably securable in the retracted position. The end walls 28 are shown in the retracted position in FIG. 3.

Figure 4:
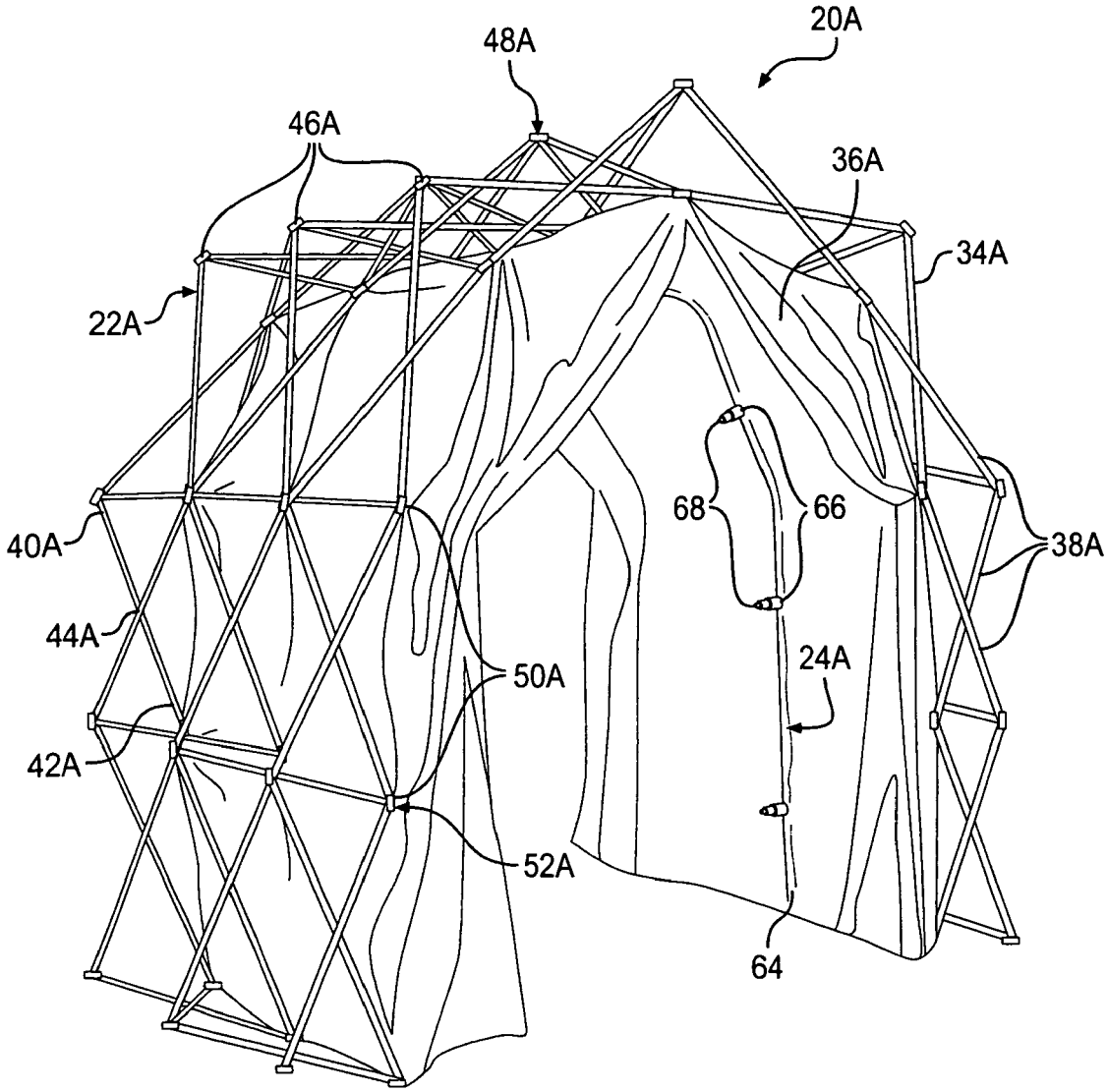
FIG. 4 is a perspective view of another embodiment of the decontamination system of the present invention with the shelter in the deployed configuration.

Another embodiment of the portable decontamination system 20A is shown in FIG. 4 with the shelter 22A in the deployed configuration. The shelter 22A of this embodiment is somewhat smaller than that of the embodiment of FIG. 3. Shelters having different sizes may also be used.

As shown in FIGS. 1-14, the shelter 22, 22A comprises an articulate frame 34, 34A and a canopy 36, 36A associated with the frame. The articulate frame 34, 34A comprises a plurality of struts 38, 38A, each strut comprising a first end 40, 40A, a second end 42, 42A, and an intermediate portion 44, 44A. The intermediate portion 44, 44A of each strut 38, 38A is pivotally connected to the intermediate portion of another strut. As used herein, "intermediate portion" means the portion of a strut between the end portions. This does not necessarily refer to the exact middle of a strut. In fact, the location of the pivoting connection on various struts may be slightly offset from the middle to provide a desired shape for a shelter or a portion of a shelter. The shape and size of a shelter may also be determined by the length of the struts used.

The struts 38, 38A comprise substantially cylindrical rods made from T-7000 aluminum. The struts 38, 38A may comprise other materials, including metals, plastics, and/or composites, for example. Struts having non-cylindrical shapes may also be used.

The frame 34, 34A further comprises a plurality of first hubs 46, 46A defining a first frame surface 48, 48A. Each first hub 46, 46A receives first ends of at least two respective struts 38, 38A and each respective strut is pivotable with respect to the first hub 46, 46A about a distinct axis. The frame 34, 34A further comprises a plurality of second hubs 50, 50A defining a second frame surface 52, 52A. Each second hub 50, 50A receives second ends of at least two respective struts 38, 38A and each respective strut is pivotable with respect to the second hub 50, 50A about a distinct axis.

When moved from the stowed configuration to the deployed configuration, the articulate frame 34, 34A expands to a vertical arch-shaped lattice framework, as shown in FIGS. 3 and 4. The frame 34, 34A is self-supporting, which eliminates the need for supplementary support devices, such as center poles. However, in cases where additional structural support is desired, such as for large shelters or in windy conditions, for example, first support elements 54 and second support elements 56 may be added to the frame 34, 34A to provide increased support.

First support elements 54 are used to connect a plurality of first hubs 46 together to limit the distance between the hubs. First support elements 54 are shown on the frame 34 in FIG. 5. As the frame 34 is being deployed, the first support elements 54 stop the articulation of the struts 38 and effectively limit the extension of the frame 34. The number of first support elements 54 used depends on the amount of additional structural support desired. Alternatively or in addition, the first support elements 54 may be used to connect a plurality of second hubs 50 together.

Figure 5:
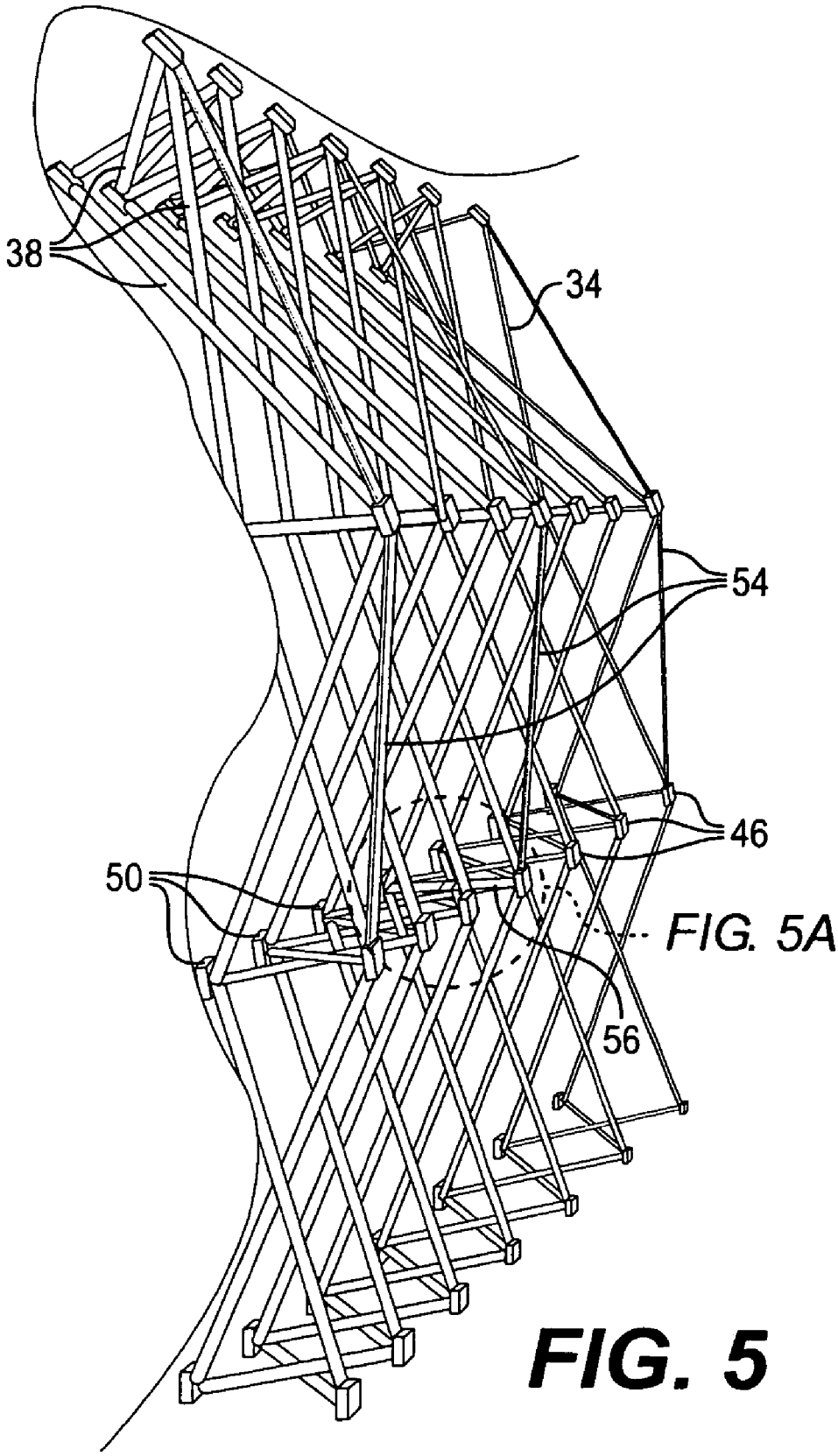
FIG. 5 is a fragmentary perspective view of an embodiment of a frame according to the present invention.

The first support elements 54 shown in FIG. 5 comprise fabric straps. Straps comprising other materials may also be used. In addition, other configurations may be used, such as metallic bands, for example. The fabric straps are connected to respective first hubs 46 using bolts. Other connection means may also be used, including for example, hook and loop fasteners, screws, snaps, adhesives, and/or magnetic fasteners. The first support elements 54 may be permanently or removably attached to the hubs.

Figure 5A:
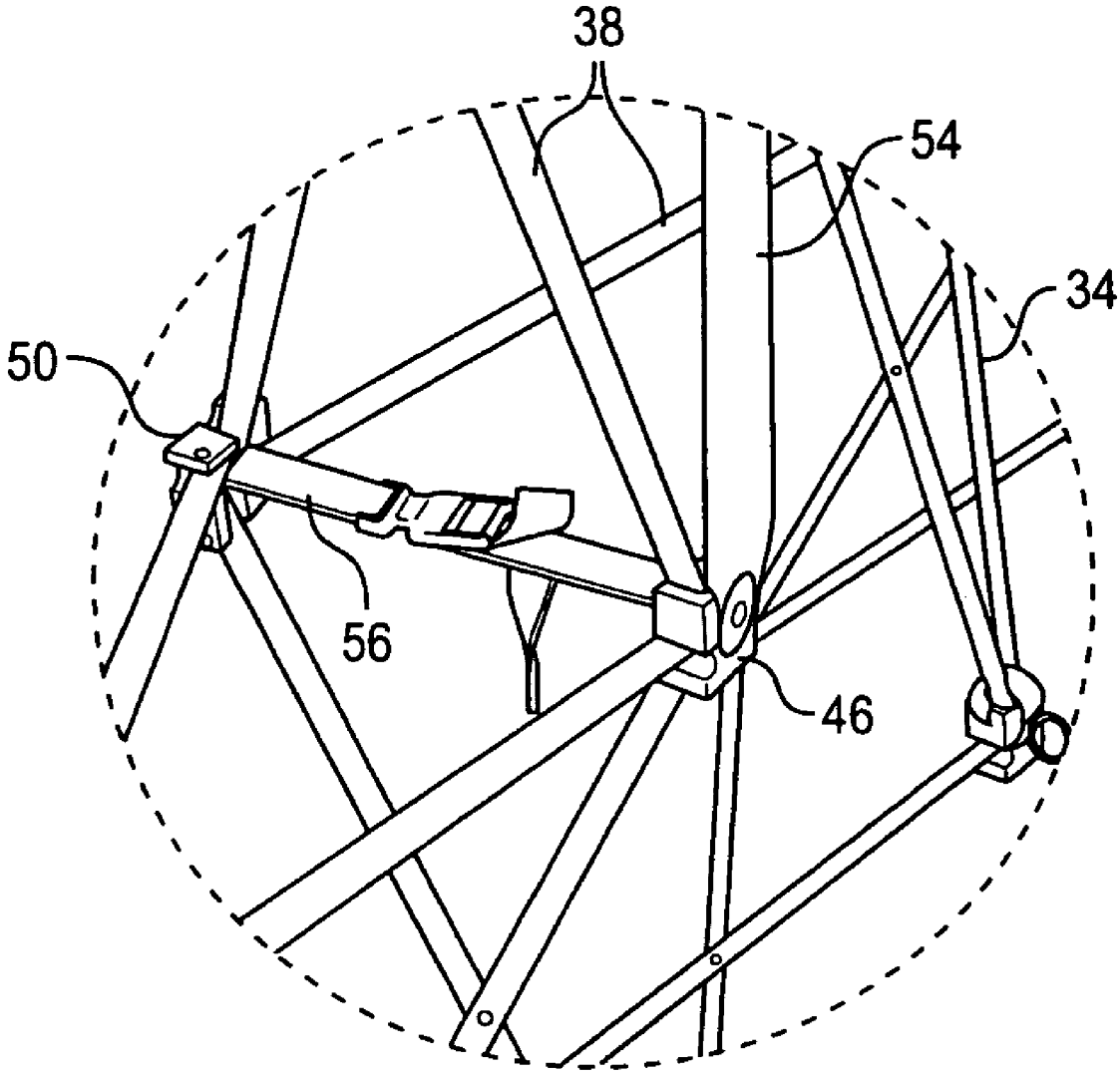
FIG. 5A is a fragmentary perspective view of the frame of FIG. 5.

Second support elements 56 are used to connect a first hub 46 to a corresponding second hub 50 to limit the distance between them. A second support element 56 is shown on the frame 34 in FIGS. 5 and 5A. As the frame 34 is being deployed, the second support elements 56, like the first support elements 54, stop the articulation of the struts 38 and effectively limit the extension of the frame 34. The second support element 56 shown in FIG. 5A comprises a fabric strap having an adjustable length and a releasable connector. The strap is bolted at each end to a respective hub 46, 50. Other connection means may also be used. In addition, other materials and arrangements may be used to provide increased support to the shelter 22, such as, for example, external tensioning lines.

As shown in FIGS. 1-4, the canopy 36, 36A is secured to the second frame surface 52, 52A. It is noted that, alternatively, the canopy 36, 36A may be secured to the first frame surface 48, 48A. The canopy 36, 36A is secured to multiple hubs 46, 46A, 50, 50A using sealed screwed connections that maintain a leakproof enclosure. Other connection means may also be used, including for example, hook and loop fasteners, bolts, snaps, adhesives, and/or magnetic fasteners. The canopy 36, 36A may be permanently or removably attached to the hubs.

Where the canopy 36 is secured to the second frame surface 52, the shelter 22 may comprise a second canopy 58 secured to the first frame surface 48, as shown in FIGS. 2 and 3. The second canopy 58 may provide additional protection from ambient weather conditions.

The canopy 36 comprises an outer fabric 60 and a liner 62. The outer fabric 60 and liner 62 comprise a material that is at least one of chemical resistant, biological resistant, ultraviolet stabilized, and flame retardant. The material may be chosen depending on its desired use. In one embodiment, a coated nylon scrim was used as the outer fabric 60. The nylon scrim, having a basis weight of approximately 5 ounces per square yard (osy), was coated on each side with a polyvinylchloride (PVC) coating to produce a chemical resistant, biological resistant, ultraviolet stabilized, and flame retardant fabric. The liner 62 used in this embodiment was a durable polyester. Alternatively, a single fabric having the desired properties may be used in place of the two-layer canopy.

A flame retardant canopy is particularly useful for applications involving indoor staging areas, such as inside an auditorium, for example. Many fire codes require flame retardancy for temporary structures in indoor locations.

The fluid delivery system 24 is configured to convey decontamination fluid into the shelter 22 and to distribute decontamination fluid throughout at least a portion of the central space 32. As shown in FIGS. 3, 4, and 6-8, the fluid delivery system 24, 24A comprises at least one flexible hose 64 and a plurality of outlets 66 on the at least one flexible hose 64. The outlets 66 may comprise a combination of nozzles 68 and connectors 70, such as, for example, quick-disconnect connectors.

In the embodiment of the portable decontamination system in FIG. 3, multiple hoses 64 extend substantially laterally across the shelter 22. The hoses 64 have nozzles 68 spaced at intervals along their length to distribute decontamination fluid throughout the central space 32 of the shelter 22. The hoses 64 are spaced longitudinally along the length of the shelter 22. In the embodiment of FIG. 4, the shelter 22A is provided with a single flexible hose 64 having a plurality of nozzles 68. Shelters may be provided with a different number and/or a different arrangement of hoses than those described herein.

The flexible hoses 64 comprise a fabric material that collapses when the hose is empty. Alternatively, the flexible hoses 64 may be formed from a variety of other materials, including rubber, plastic, and/or other natural or synthetic materials. The flexible hoses 64 allow the shelter 22 to be easily converted to the stowed position for storage and/or transport. In one embodiment, a fabric hose was used to provide water to the central space 32 of the shelter 22 at a pressure of approximately 40 pounds per square inch (psi). Flexible hoses of various sizes may be used to convey decontamination fluid into the shelter at a range of pressures, depending on the application.

The fluid delivery system 24 is integral with the shelter 22. As used herein, "integral with" means secured to so as to be a part of. In the embodiments of FIGS. 3 and 4, the flexible hoses 64 are removably secured to the interior surface of the shelter 22 using a flap formed from the liner and secured with hook and loop fasteners. The hoses 64 may also be removably secured to the shelter 22 by at least one of mechanical fasteners, magnetic fasteners, and adhesives. As shown, the hoses 64 are secured to an interior surface of the side walls 26 and to an interior surface of the roof 30. Alternatively, the hoses 64 may be secured to an outer surface of the shelter 22.

In an alternative embodiment, the fluid delivery system 24 may be permanently secured to the shelter 22. In one example, the components may be formed together as a single part, e.g., in a unitary construction. In another example, the components may be formed separately and then permanently secured together.

Many types of decontamination fluid may be used with the present invention, including liquids and foams, for example. The decontamination fluid may include water and/or one or more chemicals. In addition, various combinations of fluids may be used.

In one embodiment, a single hose 64 may be used to provide a single decontamination fluid within the shelter 22. In another embodiment, multiple hoses 64 may be used to provide a single decontamination fluid along the length of the shelter 22. In a still further embodiment, different fluids may be used in successive hoses 64 along the length of the shelter 22 to provide a sequential application of different fluids, for example, water, then foam, then a chemical solution, then water. Other types of fluids and distributions of fluids may also be used.

The portable decontamination system 20 may be used to remove hazardous substances, including, for example, chemical, biological, and/or radiological substances. The system may also be used to remove non-hazardous substances, such as dirt or debris, for example, from a range of articles, including, for example, people, animals, and equipment of all types.

Figure 6:
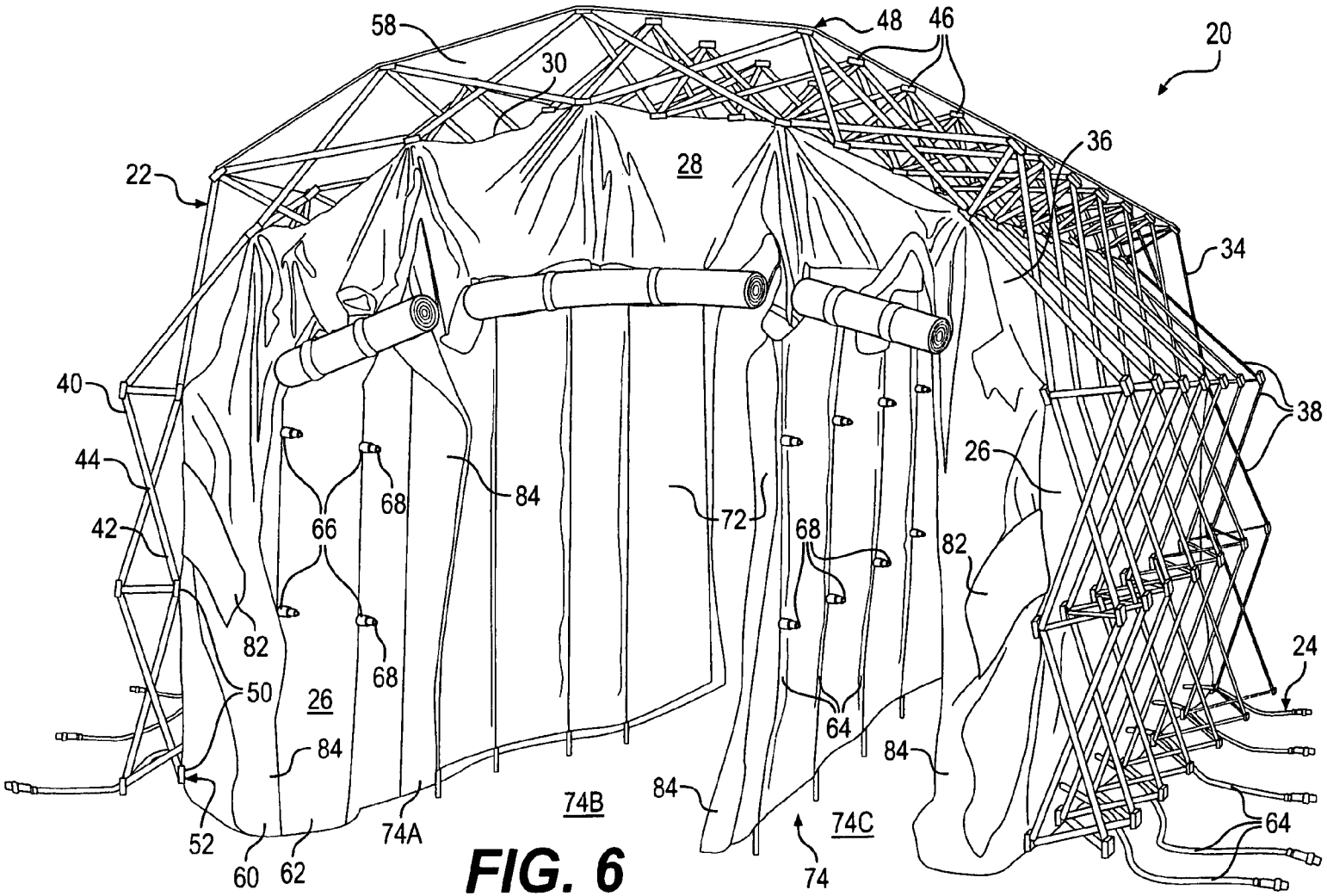
FIG. 6 is a perspective view of the decontamination system of FIG. 3 having partitions.

The embodiment of the portable decontamination system shown in FIG. 6 further comprises partitions 72 disposed within the shelter 22 and extending between the end walls 28 to define separate spaces 74 within the central space 32. The partitions 72 comprise the same durable polyester material as the liner 62. Other materials may also be used.

As shown, two partitions 72 divide the central space 32 into three separate spaces 74A-74C. Other numbers and orientations of partitions 72 may also be used. The separate spaces 74 may be used to segregate accident victims for decontamination based on gender, for example. This may be desirable where decontamination involves disrobing. In one example, the two outer separate spaces 74A, 74C may be used by men and women, respectively, and the central separate space 74B may be used for non-ambulatory victims on stretchers and/or other conveyors. The central separate space 74B of the shelter 22 shown in FIG. 6 is wider than the outer separate spaces 74A, 74C to accommodate non-ambulatory victims. The central separate space 74B may also be used to decontaminate equipment and/or other articles.

Figure 7:
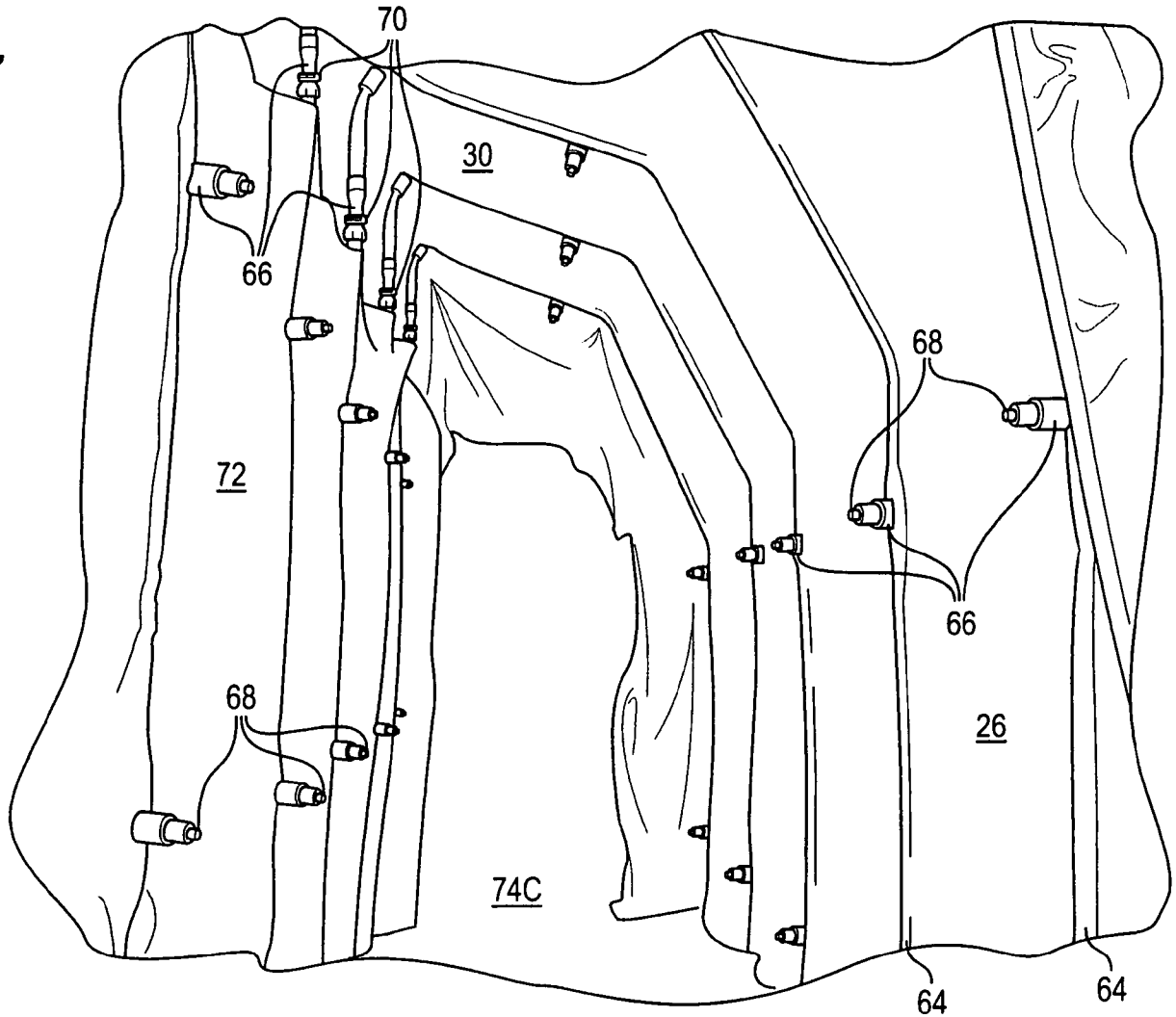
FIG. 7 is a fragmentary perspective view showing details of an interior portion of the shelter of FIG. 6.

The flexible hoses 64 are removably secured to a surface of the partitions 72 using a flap of material secured with hook and loop fasteners, as shown in FIG. 7. Other removable and/or permanent attachment means may also be used.

Figure 8:
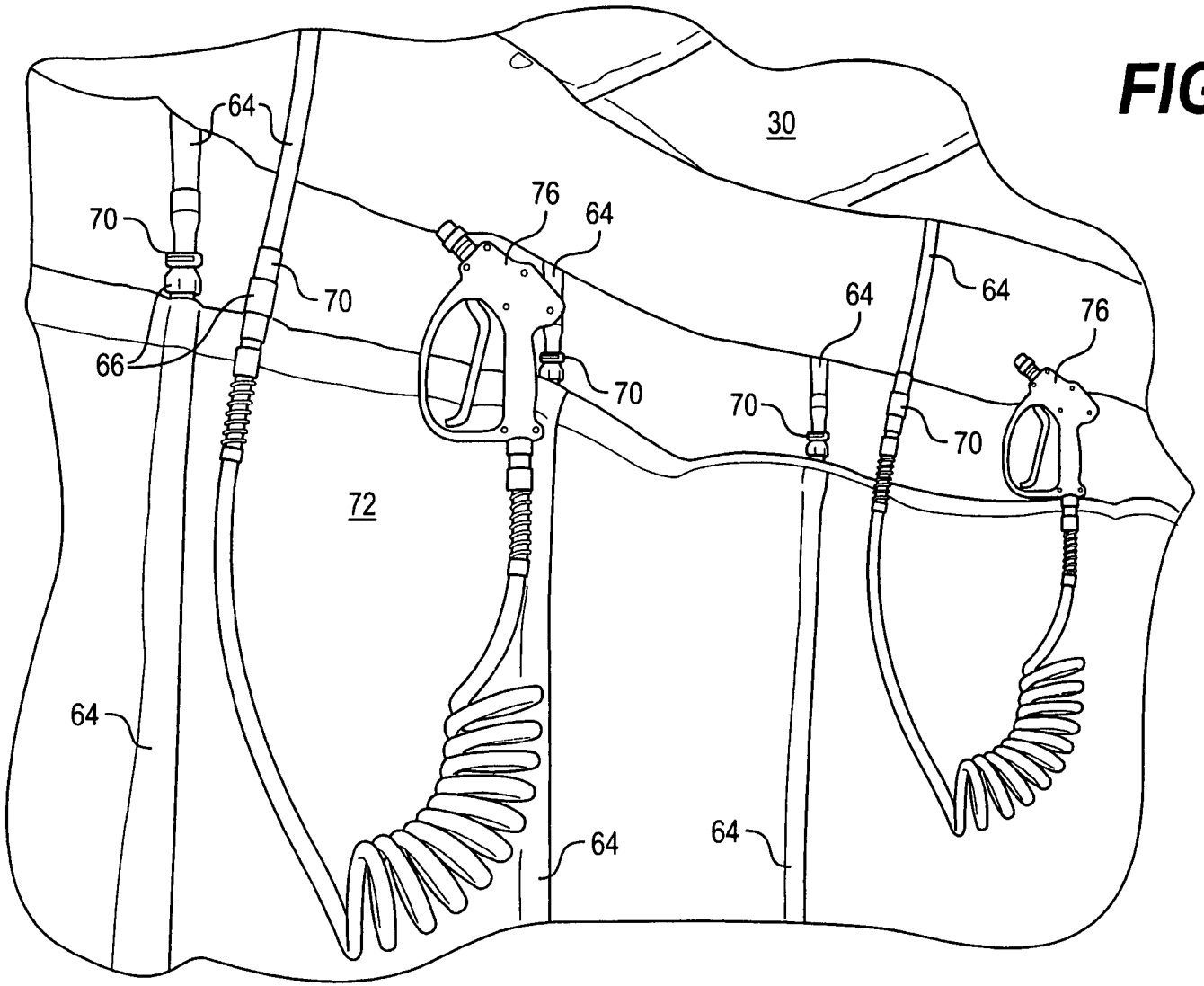
FIG. 8 is a fragmentary perspective view showing details of another interior portion of the shelter of FIG. 6.

The hoses 64 secured to the partitions 72 terminate in connectors 70 located above the partitions 72, as shown in FIGS. 7 and 8. The connectors 70 may be quick-disconnect connectors. These connectors 70 mate with connectors 70 disposed on the ends of the hoses 64 secured to the walls 26 and roof 30 of the shelter 22. Thus, the hoses 64 on the walls 26 and roof 30 of the shelter 22 provide decontamination fluid to the hoses 64 on the partitions 72. Further, the partitions 72 are at least partially supported by the flexible hoses 64 secured to the roof 30 of the shelter 22. Alternatively or in addition, clips may be provided on an inner surface of the shelter 22 to bear the weight of the partitions 72.

On the hoses 64 of each partition 72, the nozzles 68 are directed into the respective outer separate spaces 74A, 74C. Combined with the nozzles 68 of the hoses 64 secured to the walls 26 and roof 30 of the shelter 22, these nozzles 68 produce a multi-directional spray of decontamination fluid in each outer separate space 74A, 74C. During decontamination, a victim may walk from one end of the shelter 22 to the other along a separate space 74A, 74C and be progressively cleaned along the way.

As shown in FIG. 8, several hoses 64 that terminate in connectors 70 are disposed in the central separate section 74B. These hoses 64 may be provided with manual spraying devices 76 that may be used to decontaminate non-ambulatory victims, who may be unable to move or unconscious. Attendants may be positioned in the central separate space 74B to aid the non-ambulatory victims. Alternatively, the attendants in the central separate space 74B may use the spraying devices 76 to decontaminate equipment.

Depending on its size, a shelter 22 according to the present invention may accommodate a large number of people. A shelter 22 such as that shown in FIG. 6 may accommodate three or more people in each decontamination line at a given time.

As shown in FIG. 3, there are resealable access openings 78 in the side walls 26 of the shelter 22 proximate to each end wall 28. The access openings 78 are provided with zippers to allow the openings 78 to be quickly opened and closed. Other fasteners may also be used. These openings 78 allow a person outside the shelter 22 to pass equipment, for example, to someone inside the shelter 22 or vice versa.

Also shown in FIG. 3 are two supply ports 80 on the side walls 26 of the shelter 22. These ports 80 may allow for the passage of utility cords and other similar hardware. Such cords may be required to power equipment such as lamps and/or heaters, for example. Various equipment may be supported on mounting brackets inside the shelter 22. The supply ports 80 may be sealed to prevent the leakage of contaminants from the shelter 22.

The supply ports 80 may also be used to provide and remove conditioned air to and from the shelter 22. The air may be heated, cooled, pressurized, and/or filtered before entering and/or after leaving the shelter 22.

Figure 9:
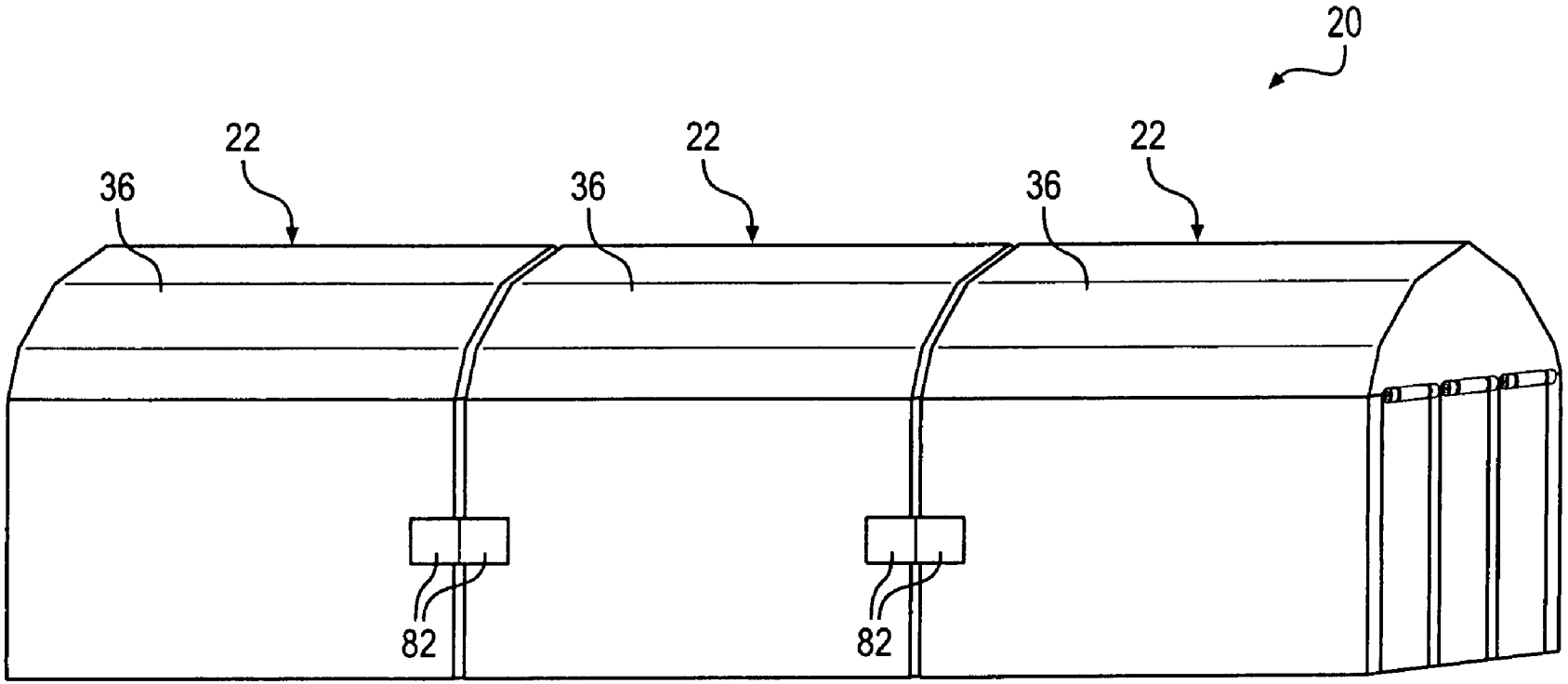
FIG. 9 is a perspective view of three shelters according to the present invention connected in series.

A plurality of connecting elements 82 extend from the shelter 22 proximate to the end walls 28, as shown in FIGS. 3, 6, and 9. The connecting elements 82 comprise a portion of canopy material provided with fasteners, such as hook and loop fasteners, for example, and are configured to engage a corresponding connecting element 82 on an adjacent shelter to allow multiple shelters 22 to be connected in series. As used herein, "connected in series" means arranged end to end, allowing sequential passage through successive shelters. Three shelters 22 connected in series are shown in FIG. 9.

The partitions 72 and the side walls 26 of the shelter 22 also have connecting portions 84 (see FIG. 6) configured to engage corresponding connecting portions 84 on adjacent shelters 22. The connection of the side walls 26 and partitions 72 maintains the continuity of the separate spaces 74A-74C along shelters connected in series. It is noted that the canopies 36 on each of the shelters 22 shown in FIG. 9 are secured to the first frame surface 48. The frames 34, therefore, are not visible. In one example, the first shelter may be used for undressing, the second shelter for showering, and the third shelter for redressing. Other numbers of shelters may be connected and utilized in a variety of ways.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A portable decontamination system comprising:

a preassembled shelter comprising:

a frame movable, in length, width, and height, between a stowed configuration and a deployed configuration, the frame remaining inseparably connected when transitioning from the stowed configuration to the deployed configuration and defining a roof, a first side wall, and a second side wall in the deployed configuration, the frame comprising:

a plurality of struts, each strut comprising a first end, a second end, and an intermediate portion, wherein the intermediate portion of each strut is pivotably connected to the intermediate portion of another strut;

a plurality of first hubs defining a first frame surface, each first hub receiving first ends of at least two respective struts, wherein each respective strut is pivotable with respect to the first hub about a distinct axis; and a plurality of second hubs defining a second frame surface, each second hub receiving second ends of at least two respective struts, wherein each respective strut is pivotable with respect to the second hub about a distinct axis;

a canopy associated with the frame, wherein the frame in the deployed configuration and the canopy enclose a central space, at least a portion of the frame defining a lattice framework extending laterally inward over the central space so as to position a plurality of the struts, first hubs, and second hubs laterally inward over the central space; and a fluid delivery system configured to convey decontamination fluid into the shelter and to distribute decontamination fluid throughout at least a portion of the central space.

2. The system of claim 1, wherein the fluid delivery system comprises:

a plurality of flexible hoses removably secured to an interior surface of the canopy; and a plurality of outlets on each flexible hose, the outlets comprising at least one of nozzles and connectors.

3. The system of claim 2, further comprising at least one partition removably disposed within the shelter to define separate spaces within the central space.

4. The system of claim 3, wherein the at least one partition is at least partially supported by the flexible hoses.

5. The system of claim 3, wherein in at least one separate space the flexible hoses are arranged on multiple interior surfaces of the canopy and on the partition, and wherein the outlets on the flexible hoses comprise nozzles.

6. The system of claim 3, wherein at least one flexible hose having at least one connector is arranged in at least one separate space.

7. The system of claim 6, further comprising manual spraying devices secured to respective connectors.

8. The system of claim 2, wherein the flexible hoses are secured to the interior surface of the canopy by at least one of mechanical fasteners, magnetic fasteners, and adhesives.

9. The system of claim 2, wherein the flexible hoses comprise a fabric material.

10. The system of claim 1, further comprising at least one resealable access opening on the canopy.

11. The system of claim 1, further comprising at least one supply port on the canopy.

12. The system of claim 1, wherein the canopy is secured to the first frame surface.

13. The system of claim 1, wherein the canopy is secured to the second frame surface.

14. The system of claim 13, further comprising a second canopy secured to the first frame surface.

15. The system of claim 1, wherein the canopy comprises a material that is at least one of chemical resistant, biological resistant, ultraviolet stabilized, and flame retardant.

16. The system of claim 1, further comprising at least one support element connecting a plurality of first hubs.

17. The system of claim 1, further comprising at least one second support element releasably connecting a first hub to a corresponding second hub.

18. The device of claim 1, wherein the struts comprise substantially cylindrical rods.

19. The device of claim 1, wherein the struts comprise a material chosen from metals, plastics, and composites.

20. The device of claim 1, wherein each distinct pivot axis of at least one first hub is substantially parallel or substantially perpendicular to each other distinct pivot axis of the respective first hub and each distinct pivot axis of at least one second hub is substantially parallel or substantially perpendicular to each other distinct pivot axis of the respective second hub.

21. A portable decontamination system comprising:

a preassembled shelter comprising:

a frame movable, in length, width, and height, between a stowed configuration and a deployed configuration, the frame remaining inseparably connected when transitioning from the stowed configuration to the deployed configuration and defining a roof, a first side wall, and a second side wall in the deployed configuration, the frame comprising:

a plurality of struts, each strut comprising a first end, a second end, and an intermediate portion, wherein the intermediate portion of each strut is pivotably connected to the intermediate portion of another strut;

a plurality of first hubs defining a first frame surface, each first hub receiving first ends of at least two respective struts, wherein each respective strut is pivotable with respect to the first hub about a distinct pivot axis, each distinct pivot axis of each first hub being substantially parallel or substantially perpendicular to each other distinct pivot axis of the respective first hub; and a plurality of second hubs defining a second frame surface, each second hub receiving second ends of at least two respective struts, wherein each respective strut is pivotable with respect to the second hub about a distinct pivot axis, each distinct pivot axis of each second hub being substantially parallel or substantially perpendicular to each other distinct pivot axis of the respective second hub;

a canopy associated with the frame, wherein the frame in the deployed configuration and the canopy enclose a central space, at least a portion of the frame defining a lattice framework extending laterally inward over the central space so as to position a plurality of the struts, first hubs, and second hubs laterally inward over the central space; and a fluid delivery system configured to convey decontamination fluid into the shelter and to distribute decontamination fluid throughout at least a portion of the central space.

22. The system of claim 21, wherein the fluid delivery system comprises:

a plurality of flexible hoses removably secured to an interior surface of the canopy; and a plurality of outlets on each flexible hose, the outlets comprising at least one of nozzles and connectors.

23. The system of claim 21, further comprising at least one partition removably disposed within the shelter to define separate spaces within the central space.

24. The system of claim 23, wherein in at least one separate space the flexible hoses are arranged on multiple interior surfaces of the canopy and on the partition, and wherein the outlets on the flexible hoses comprise nozzles.

25. The system of claim 21, further comprising at least one first support element connecting a plurality of first hubs.

26. A portable decontamination system comprising:

a preassembled shelter comprising:

a frame movable, in length, width, and height, between a stowed configuration and a deployed configuration, the frame remaining inseparably connected when transitioning from the stowed configuration to the deployed configuration and defining a roof, a first side wall, and a second side wall in the deployed configuration, the frame comprising:

a plurality of struts, each strut comprising a first end, a second end, and an intermediate portion, wherein the intermediate portion of each strut is pivotably connected to the intermediate portion of another strut;

a plurality of first hubs defining a first frame surface, each first hub receiving first ends of at least two respective struts, wherein each respective strut is pivotable with respect to the first hub about a distinct pivot axis, each first hub defining at least one strut plane and restricting the movement of each of the struts connected thereto to a respective strut plane, each respective strut plane being one of parallel or perpendicular to each other strut plane defined by the respective first hub; and a plurality of second hubs defining a second frame surface, each second hub receiving second ends of at least two respective struts, wherein each respective strut is pivotable with respect to the second hub about a distinct pivot axis, each second hub defining at least one strut plane and restricting the movement of each of the struts connected thereto to a respective strut plane, each respective strut plane being one of parallel or perpendicular to each other strut plane defined by the respective second hub;

a canopy associated with the frame, wherein the frame in the deployed configuration and the canopy enclose a central space, at least a portion of the frame defining a lattice framework extending laterally inward over the central space so as to position a plurality of the struts, first hubs, and second hubs laterally inward over the central space; and a fluid delivery system configured to convey decontamination fluid into the shelter and to distribute decontamination fluid throughout at least a portion of the central space, the fluid delivery system comprising:

a plurality of flexible hoses removably secured to an interior surface of the canopy, and a plurality of outlets on each flexible hose, the outlets comprising at least one of nozzles and connectors.

27. The system of claim 26, further comprising at least one partition removably disposed within the shelter to define separate spaces within the central space.

28. The system of claim 27, wherein in at least one separate space the flexible hoses are arranged on multiple interior surfaces of the canopy and on the partition, and wherein the outlets on the flexible hoses comprise nozzles.

29. The system of claim 26, further comprising at least one first support element connecting a plurality of first hubs.

* * * * *